US006845285B2

(12) United States Patent
Kakimoto et al.

(10) Patent No.: US 6,845,285 B2
(45) Date of Patent: Jan. 18, 2005

(54) KNITTING SUPPORT SYSTEM AND KNITTED PRODUCT AND KNITTING SUPPORT SERVER SYSTEM

(75) Inventors: Sadatoshi Kakimoto, Wakayama (JP); Gakuyuki Hayashi, Wakayama (JP)

(73) Assignee: Shima Seiko Manufacturing Limited, Wakayama (JP)

( * ) Notice: Subject to any disclaimer, the term of this patent is extended or adjusted under 35 U.S.C. 154(b) by 87 days.

(21) Appl. No.: 10/380,823

(22) PCT Filed: Sep. 14, 2001

(86) PCT No.: PCT/JP01/08037

§ 371 (c)(1),
(2), (4) Date: Jul. 30, 2003

(87) PCT Pub. No.: WO02/24996

PCT Pub. Date: Mar. 28, 2002

(65) Prior Publication Data

US 2004/0006406 A1 Jan. 8, 2004

(30) Foreign Application Priority Data

Sep. 19, 2000 (JP) ..... 2000-284062

(51) Int. Cl.[7] ..... G06F 19/00; D04B 39/00
(52) U.S. Cl. ..... 700/141; 66/75.2
(58) Field of Search ..... 700/141, 131, 700/132; 66/75.2, 232

(56) References Cited

U.S. PATENT DOCUMENTS

| | | | |
|---|---|---|---|
| 4,736,324 | A | 4/1988 | Sainen et al. |
| 5,230,227 | A | 7/1993 | Kondoh et al. |
| 5,388,050 | A | 2/1995 | Inoue et al. |
| 6,233,979 | B1 * | 5/2001 | Plath ..... 66/232 |

FOREIGN PATENT DOCUMENTS

| | | |
|---|---|---|
| DE | 2 301 847 | 7/1974 |
| EP | 568700 | 11/1993 |
| JP | 61-239057 | 10/1986 |
| JP | 3-158190 | 7/1991 |
| JP | 5-5251 | 1/1993 |
| JP | 5-78960 | 3/1993 |
| JP | 6-162042 | 6/1994 |
| WO | 93/06285 | 4/1993 |

OTHER PUBLICATIONS

Helmut Schlotterer, "Flat Machine Programming", Knitting International, vol. 106, No. 1257, pp. 38–42, (1999).

Jean–Marie Bachmann, "La CAO et la maille", Filiere Maille, No. 54 pp. 59–61 (1999) XP002270452.

* cited by examiner

*Primary Examiner*—Peter Nerbun
(74) *Attorney, Agent, or Firm*—Wenderoth, Lind & Ponack, L.L.P.

(57) ABSTRACT

A knitting support system of the invention includes knitting machine adjusting data storing means (28) for storing the knitting machine adjusting data for many fabrics; search information storing means (22) in which various kinds of parameters of the fabrics are stored as search information for searching fabrics similar to that of a knitted product to be knitted from among the stored knitting machine adjusting data; searching means (24) for inputting parameters of the knitted product to be knitted as searching conditions and searching similar fabrics from among the search information stored in the search information storing means (22) in accordance with the inputted searching conditions; and output means (30) for reading and outputting the knitting machine adjusting data for the fabrics corresponding to the searched result of the searching means (24) from the knitting machine adjusting data storing means (28).

4 Claims, 8 Drawing Sheets

FIG. 5

LIST OF ADJUST DATA

LOOP LENGTH | SPEED | CORRECTION OF RACKING | PULLING DOWN TENSION | STITCH DENSITY

| | S1 | | S2 | | S3 | | S4 | |
|---|---|---|---|---|---|---|---|---|
| | FRONT | BACK | FRONT | BACK | FRONT | BACK | FRONT | BACK |
| 1 | 9.51 | 9.51 | 9.51 | 9.51 | 9.51 | 9.51 | 9.51 | 9.51 |
| 2 | 10.30 | 10.30 | 10.30 | 10.30 | 10.30 | 10.30 | 10.30 | 10.30 |
| 3 | 8.83 | 8.83 | 8.83 | 8.83 | 8.83 | 8.83 | 8.83 | 8.83 |
| 4 | 9.65 | 9.65 | 9.65 | 9.65 | 9.65 | 9.65 | 9.65 | 9.65 |
| 5 | 11.91 | 11.91 | 11.91 | 11.91 | 11.91 | 11.91 | 11.91 | 11.91 |
| 6 | 9.51 | 9.51 | 9.51 | 9.51 | 9.51 | 9.51 | 9.51 | 9.51 |
| 7 | 10.30 | 10.30 | 10.30 | 10.30 | 10.30 | 10.30 | 10.30 | 10.30 |
| 8 | 8.83 | 8.83 | 8.83 | 8.83 | 8.83 | 8.83 | 8.83 | 8.83 |
| 9 | 9.65 | 9.65 | 9.65 | 9.65 | 9.65 | 9.65 | 9.65 | 9.65 |
| 10 | 11.91 | 11.91 | 11.91 | 11.91 | 11.91 | 11.91 | 11.91 | 11.91 |

46 — SAVE

FIG. 7

54

SEARCH RESULT

| PARTS | FABRIC CODE |
| --- | --- |
| THE BODY OF GARMENT | Y054 |
| METHOD FOR KNITTING SHOULDER | Y068 |
| ATTACHING OF SLEEVE | Y071 |
| NECK TYPE | Y074 |
| BOTTOM TYPE | Y080 |

SET CANCEL

KNITTING SUPPORT SYSTEM AND KNITTED PRODUCT AND KNITTING SUPPORT SERVER SYSTEM

TECHNICAL FIELD

The invention relates to a knitting support system and a knitting support server system for supporting a knitting operation when a knitted product is formed using a knitting machine.

BACKGROUND ART

The number of kinds of knitted products capable of being knitted has been outstandingly increased more than before as a result of the technical progress of a knitting machine. These knitted products are designed by using a CAD. Thus, a knitting program can be obtained.

However, in order to complete a desired knitted product by utilizing the prepared knitting program, various kinds of adjust data for a knitting machine need to be set to the knitting machine side. The variety of knitting machine adjusting data to be set to the knitting machine includes, for instance, loop length, knitting speed, correction of racking, fabric pulling down tension, etc. When values set to the knitting machine adjusting data are inadequate, the knitted product is knitted inappropriately. For instance, when the loop length is improperly set and an extremely small value is set, a yarn may be broken during a knitting operation so that the knitting operation cannot be continued. Conversely, when an extremely large value is set to the loop length, a problem such as a stitch trip or the like arises. An adequate value of the loop length is not always constant. The value is different depending on parameters, for instance, the designs of knitted products, knitting yarns to be used, gauges of knitting machines, etc.

As described above, with the technical progress of the knitting machine, the number of kinds of knitted products capable of being knitted has been outstandingly increased. However, when proper knitting machine adjusting data is not set to the knitting machine so as to correspond to the knitted products to be knitted, even if a knitting program is properly prepared, a situation that the knitted products cannot be knitted may arise. Therefore, proper knitting machine adjusting data needs to be set to the knitting machine for each of the knitted products.

However, since many parameters are necessary for determining the knitting machine adjusting data for individual knitted products, the parameters are not set with ease. Especially, it is an extremely time-consuming and troublesome work with the repetition of tries and errors for an operator little experienced in the knitting machine to set the knitting machine adjusting data and execute a knitting program in the knitting machine.

With the above-described problems taken into consideration, it is an object of the invention to provide a knitting support system for knitted products and a knitting support server system which, when the knitted products are formed using the knitting machine, support a user to easily obtain knitting machine adjusting data suitable for a desired knitted product to be set to the knitting machine.

DISCLOSURE OF INVENTION

The invention provides a knitting support system comprising:

knitting machine adjusting data storing means for storing knitting machine adjusting data for many fabrics;

search information storing means for storing various kinds of parameters of the fabrics as search information for searching fabrics similar to that of a knitted product to be knitted from among the knitting machine adjusting data stored in the knitting machine adjusting data storing means;

searching means for inputting parameters of the knitted product to be knitted as searching conditions and searching fabrics similar to that of the knitted product to be knitted from among the search information stored in the search information storing means in accordance with the inputted searching conditions; and output means for reading and outputting the knitting machine adjusting data for the fabrics corresponding to the searched result of the searching means from the knitting machine adjusting data storing means.

In the invention it is preferable that the knitting support system comprises analyzing means for analyzing and balancing the knitting machine adjusting data for plural desired fabrics from among a plurality of sets of knitting machine adjusting data, when, as a result of searching by the searching means, the plurality of sets of knitting machine adjusting data for fabrics similar to that of the knitted product to be knitted are obtained.

In the invention it is preferable that the searching means searches fabrics similar to those of respective parts of the knitted product to be knitted from among the search information stored in the search information storing means, in accordance with parameters for the respective parts of the knitted product to be knitted which parameters are inputted as searching conditions, respectively, and the output means reads and outputs the knitting machine adjusting data for fabrics similar to those of the respective parts corresponding to the searched results of the searching means from the knitting machine adjusting data storing means.

Further, the invention provides a server system having transmitting and receiving means connected to communicate so as to transmit data to and receive data from a plurality of client systems, the server system comprising:

knitting machine adjusting data storing means for storing knitting machine adjusting data for many fabrics;

search information storing means for storing various kinds of parameters of fabrics as search information for searching fabrics similar to that of the knitted product to be knitted from among the knitting machine adjusting data stored in the knitting machine adjusting data storing means;

searching means for searching fabrics similar to that of the knitted product to be knitted from among the search information stored in the search information storing means in accordance with parameters of the knitted product to be knitted transmitted from the client systems which are received as the searching conditions by the server system; and output means for reading and outputting the knitting machine adjusting data for the fabrics corresponding to the searched results of the searching means, from the knitting machine adjusting data storing means, the knitting machine adjusting data outputted from the output means being transmitted to the client systems by the transmitting and receiving means.

BRIEF DESCRIPTION OF DRAWINGS

FIG. 5 shows a list of adjust data for a knitting machine of the embodiment shown in FIG. 1.

FIG. 7 shows searched results by searching means of the second embodiment.

BEST MODE FOR CARRYING OUT THE INVENTION

Figure 1:
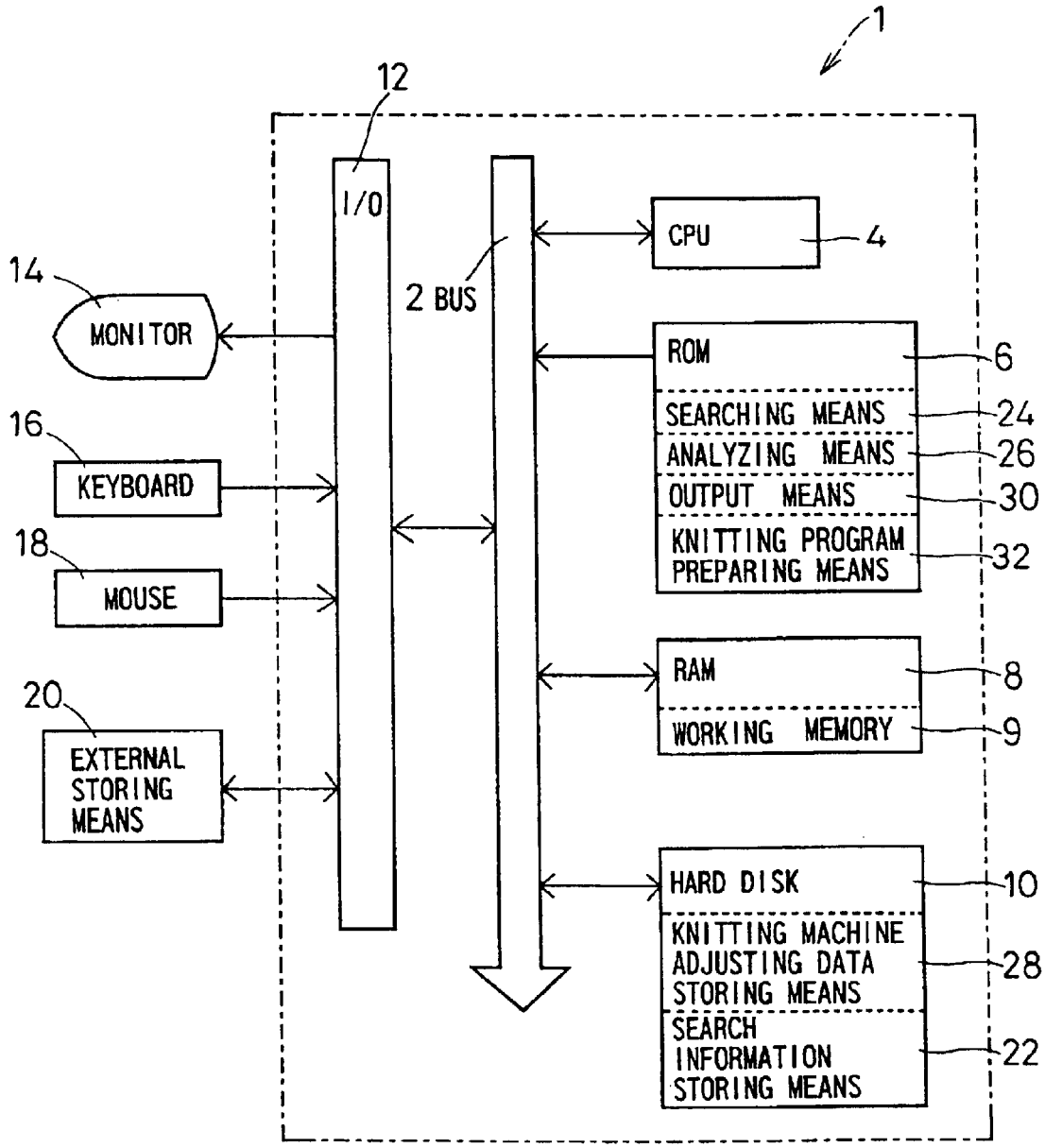
FIG. 1 is a block diagram showing a schematic structure of a knitting support system of a first embodiment.

Embodiments of the invention will be described by referring to the drawings. FIG. 1 shows a structure of a knitting support system 1 of a knitted product according to the invention. Reference numeral 2 denotes a bus and the bus 2 is shown as one bus without discriminating a data bus from other instruction buses. Reference numeral 4 denotes a CPU for performing various kinds of data processes. Reference numeral 6 denotes a ROM which stores various types of programs. Reference numeral 8 denotes a RAM having a readable and write-able working memory 9. Reference numeral 10 denotes a hard disk.

Further, reference numeral 12 denotes an I/O device to which a monitor 14 for displaying an image, a keyboard 16 and a mouse 18 which input data, and external storing means 20 as a drive of a floppy disk or a photo-electromagnetic disk or the like are connected.

The ROM 6 stores programs which form searching means 24 for searching search information stored in below-described search information storing means 22, analyzing means 26 for carrying out a process to the searched result by the searching means 24 and output means 30 for reading and outputting knitting machine adjusting data for fabrics corresponding to the searched result of the searching means 24 from below-described knitting machine adjusting data storing means 28. The CPU 4 reads these programs to the RAM 8 to execute them. In this embodiment, the RAM 6 also stores a program which forms knitting program preparing means 32 for preparing a knitting program that designs a desired knitted product and performs a knitting operation by a knitting machine. This program is adapted to be used as a CAD for knitting.

The hard disk 10 is provided with the knitting machine adjusting data storing means 28 and the search information storing means 22. In the knitting machine adjusting data storing means 28, the knitting machine adjusting data set in knitting many fabrics such as sweaters or tank tops having good knitting results which have been knitted is stored for each fabric. Further, in the search information storing means 22, the search information for searching knitted fabrics with good results similar to that of the desired knitted product is stored for each fabric. In this embodiment, the knitting machine adjusting data storing means 28 and the search information storing means 22 are realized using a data base.

Even when the desired knitted product is designed and the knitting program of the knitted product is properly prepared by the knitting program preparing means 32, values of the knitting machine adjusting data to be set to the knitting machine may not be possibly adequate. In this case, the knitted product cannot be knitted appropriately by the knitting machine.

The knitting machine adjusting data includes setting items such as loop length, knitting speed, correction of racking, pulling down tension, stitch density, etc. Further, in this embodiment, as the search information for searching fabrics knitted with knitting results, parameters 33 are set. The parameters 33 include types of knitting machine, types of knitting, items, knitting texture, attaching methods of sleeves, methods for knitting shoulders, neck types, bottom types, materials of yarn, yarn count etc. are set. The items include, for example, a sweater, a tank top, one piece, a skirt, etc. The knitting texture includes a plain stitch, a tissue pattern, wide rib stitch, a plain stitch plus wide rib stitch, etc. The attaching methods of sleeves include a set-in, a raglan, no-sleeve, etc. As the materials of yarn, wool, cotton, acryl, nylon, etc. are registered.

In order to decide which of the parameters 33 is preferentially searched by the searching means 24, priority may be given to the parameters of the search information.

The knitting machine adjusting data and the search information are coordinated with each other by fabric codes 34 of the knitted product.

The processing of the knitting support system 1 for knitted products according to the invention will be described by referring to FIG. 2.

Figure 2:
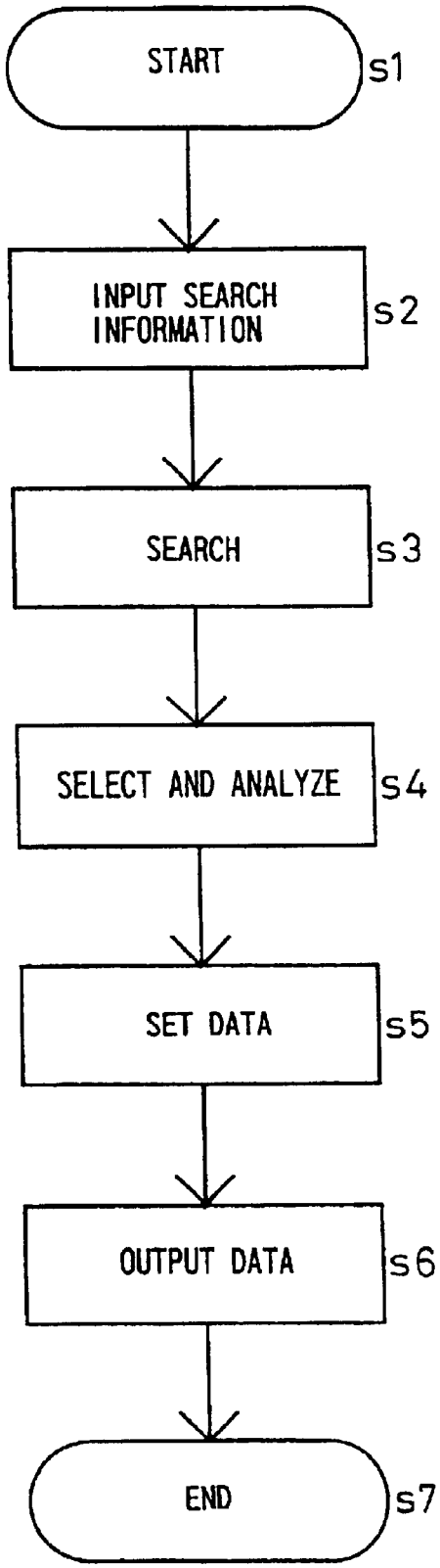
FIG. 2 is a flow chart showing the procedure of the knitting support system shown in FIG. 1.

FIG. 2 is an entire flow chart of the knitting support system 1. At this time, it is assumed that the knitting program of a desired knitted product is to be already prepared by the knitting program preparing means 32.

Figure 3:
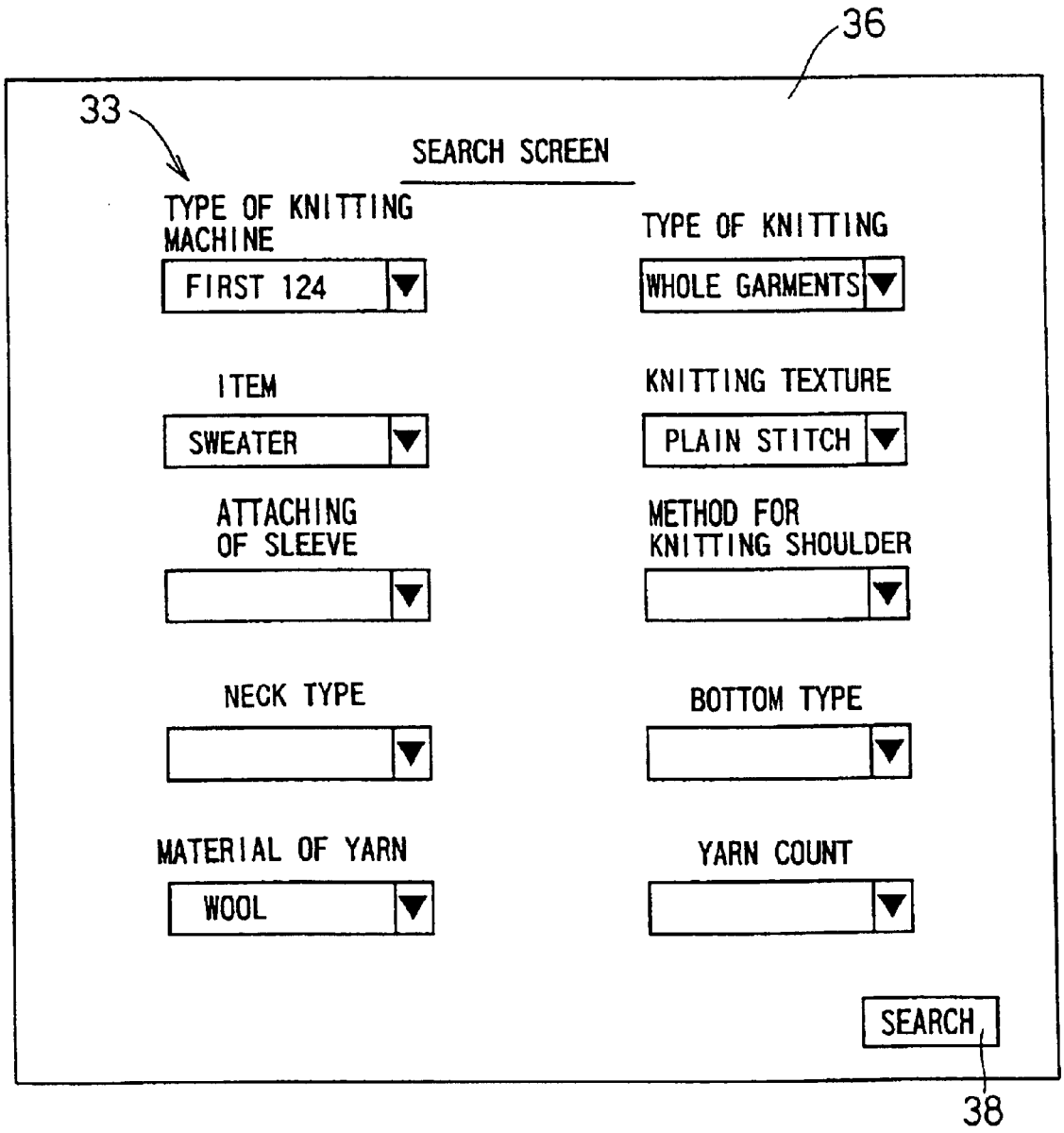
FIG. 3 shows a searching condition input screen of the embodiment shown in FIG. 1.

Firstly, at step s1, a process is started. At step s2, the data of various kinds of parameters 33 of the desired knitted product are inputted by the keyboard 16, the mouse 18 or the like in accordance with a searching condition input screen 36 shown in FIG. 3. Upon inputting the data, when each parameter 33 is clicked, the registered data is displayed in a list, so that the data is selected from the list. The data may not be inputted to all the parameters 33.

After the data is inputted, a search execution key 38 provided in the searching condition input screen 36 is pressed to advance to step s3. At the step s3, fabrics adapted to the searching conditions inputted at the step s2 are searched from among the search information stored in the search information storing means 22 of the hard disk 10 by the searching means 24.

Figure 4:
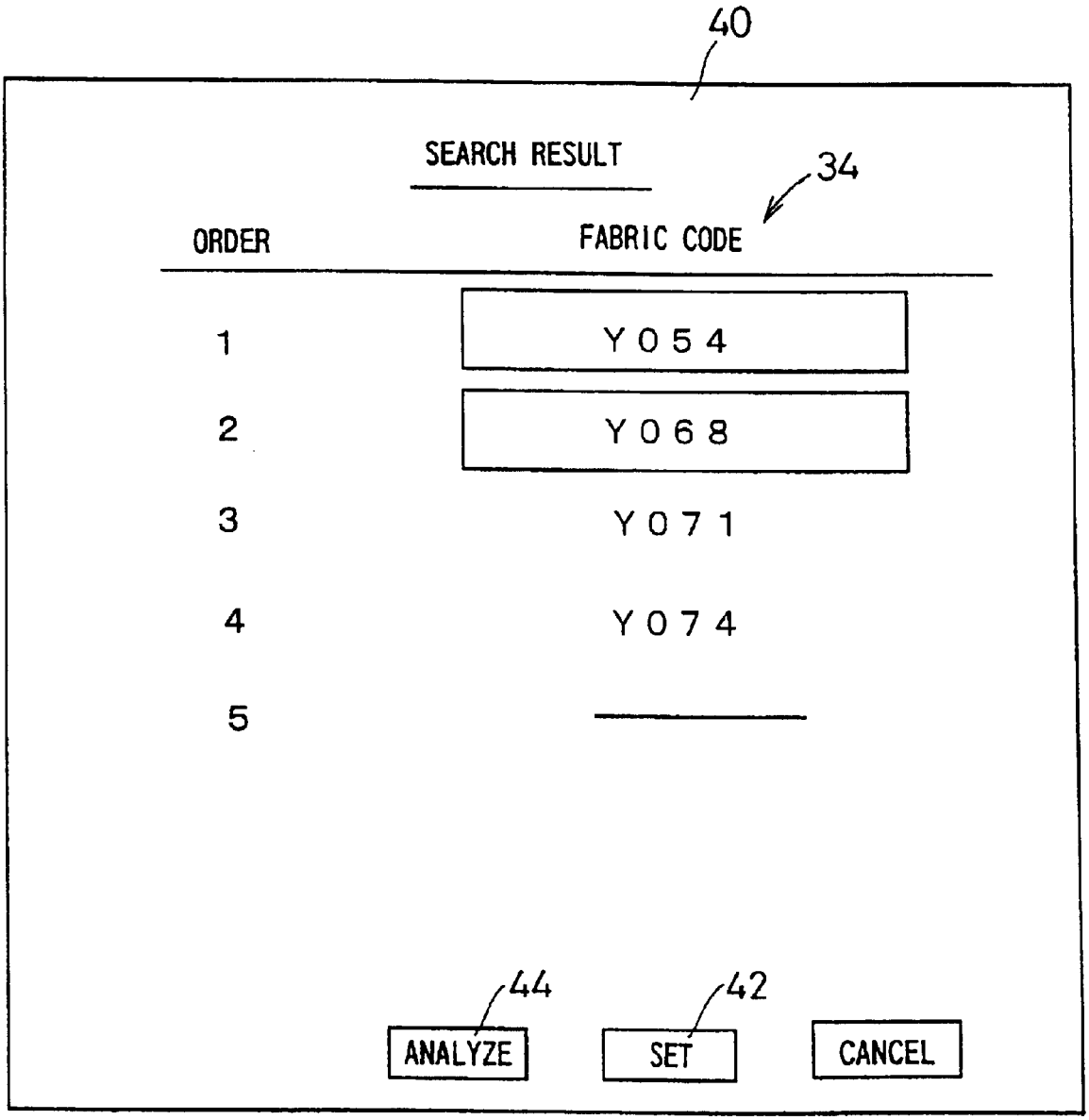
FIG. 4 shows searched results by searching means of the first embodiment shown in FIG. 1.

The searching means 24 searches fabrics adapted to the searching conditions and displays the searched results as shown in FIG. 4 on the monitor 14. In the case where the quantity of storage of the data of fabrics with knitted results stored in the search information storing means 22 and the knitting machine adjusting data storing means 28 is small and fabrics that satisfy all of the inputted searching conditions are not searched, at least one fabric with high relevance factor that satisfies a prescribed standard for the searching conditions is searched on the basis of the priority given to each of the parameters. When a plurality of fabrics are searched, the fabric codes 34 of the fabrics are arranged and displayed in order of high relevance factor.

At step s4, the most similar fabric to that of the desired knitted product is selected from the searched results by the searching means 24. When only one of the fabrics is a similar fabric, this fabric is selected. Upon selecting the fabric, the fabric code 34 displayed on a searched result screen 40 is clicked by the mouse 18 and a set key 42 is pressed to select the fabric. The knitting machine adjusting data corresponding to the selected fabric is read from the knitting machine adjusting data storing means 28 by the output means 30 and set to the working memory 9 of the RAM 8.

When a plurality of similar fabrics exist, the most similar fabric is selected from among them or some desired fabrics are selected and the knitting machine adjusting data corresponding to these fabrics is analyzed and balanced. As for the items of the knitting machine adjusting data to be balanced, for instance, only a specific item such as loop length may be balanced or a plurality of items may be balanced. When knitting machine adjusting data corresponding to the plural fabrics is balanced, the fabric codes 34 corresponding to the fabrics to be balanced are clicked and selected to press an analyze key 44. Thus, the analyzing means 26 analyzes the knitting machine adjusting data for the selected fabrics to balance the data. The balanced knitting machine adjusting data is set to the working memory 9 of the RAM 8.

The analyzing means 26 balances the knitting machine adjusting data for the selected plural fabrics. In addition thereto, for instance, the analyzing means 26 may analyze data set to a specific item from the knitting machine adjusting, search fabrics having the most frequently set data or search the smallest one or the largest one among the set data.

Further, according to this embodiment, although the fabrics searched by the searching means 24 at the step s3 only have their fabric codes 34 displayed, the knitting machine adjusting data for the respective fabrics may be displayed to be compared. Further, the image data of the fabrics which store the knitting machine adjusting data may be registered in the hard disk and the fabrics may be easily selected from among the fabrics searched by the searching means 24, for example, by displaying the image data.

At step s5, the knitting machine adjusting data corresponding to the fabric selected in the step s4 or the knitting machine adjusting data obtained by analyzing the knitting machine adjusting data corresponding to the plural selected fabrics are displayed in a list on the monitor 14 as shown in FIG. 5. At this step, the knitting machine adjusting data may be corrected as required.

Then, at step s6, when the knitting machine adjusting data whose list is displayed in FIG. 5 is satisfactory, a save key 46 is pressed. The knitting machine adjusting data is outputted together with the knitting program prepared by the knitting program preparing means 32 to a magneto optical disk or the like by the output means 30. When the knitting machine for forming knitted product is connected to the system 1 through a network, the knitting machine adjusting data and the knitting program are transmitted to a controller of the knitting machine not shown in the drawings. Then, the process advances to step s7 to complete the process.

The knitting machine adjusting data stored in the data storing means 28 for the knitting machine of the hard disk 10 shows the data of many fabrics which have been knitted with good knitting results. The searching means 24 searches the fabrics with good knitting results in the past which are similar to that of a desired knitted product. Accordingly, when the knitting machine adjusting data for the fabrics to be searched is used to knit the desired knitted product by the knitting machine, a knitted product with fabrics similar by a certain degree to that of the desired knitted product can be formed. In such a way, a first sample is knitted. As a result, when the desired knitted product is not completely knitted, an operator then decides which item of the knitting machine adjusting data needs to be corrected based on the knitted fabric to correct the knitting machine adjusting data. Then, when the desired knitted product can be completely formed, the knitting machine adjusting data used upon knitting and search information for searching it are additionally stored respectively in the knitting machine adjusting data storing means 28 and the search information storing means 22.

Knitting machine adjusting data for knitting a desired knitted product has been hitherto set from a condition having nothing. However, as described above, the data near by a certain degree to the knitting machine adjusting data suitable for the desired knitted product can be easily obtained. Accordingly, a time necessary for trial knitting can be reduced.

In the embodiment, the knitting machine adjusting data and the search information for searching it are respectively stored in the knitting machine adjusting data storing means 28 and the search information storing means 22 in the hard disk 10. However, the knitting machine adjusting data storing means 28 and the search information storing means 22 may not be provided in the incorporated hard disk 10 and may be provided in an externally connected hard disk, a media such as a DVD or CD-ROM.

Further, when a plurality of systems 1 are connected together through a network by a LAN, each of systems 1 may share data stored in the knitting machine adjusting data storing means 28 and the search information storing means 22. Thus, each of the systems does not need to have the knitting machine adjusting data and the search information and the duplication of the data can be avoided.

The knitting support system 1 of the invention may be provided in the controller of the knitting machine for knitting knitted products (not shown).

Now, a second embodiment of the invention will be described. Parts corresponding to those of the previously described first embodiment are denoted by the same reference numerals. In the first embodiment shown in FIG. 1, the searching means 24 searches the fabrics entirely similar to that of the desired knitted product including parts respectively forming the knitted product from among the search information stored in the search information storing means 22. The knitting machine adjusting data corresponding to the fabrics is outputted by the output means 30.

In the second embodiment, fabrics similar to that of the desired knitted product are respectively searched for each of the parts of the knitted product. The output means 30 outputs knitting machine adjusting data for the fabrics of the respective parts which are searched by searching means 24 and are similar to those of the respective parts of the desired knitted product.

Figure 6:
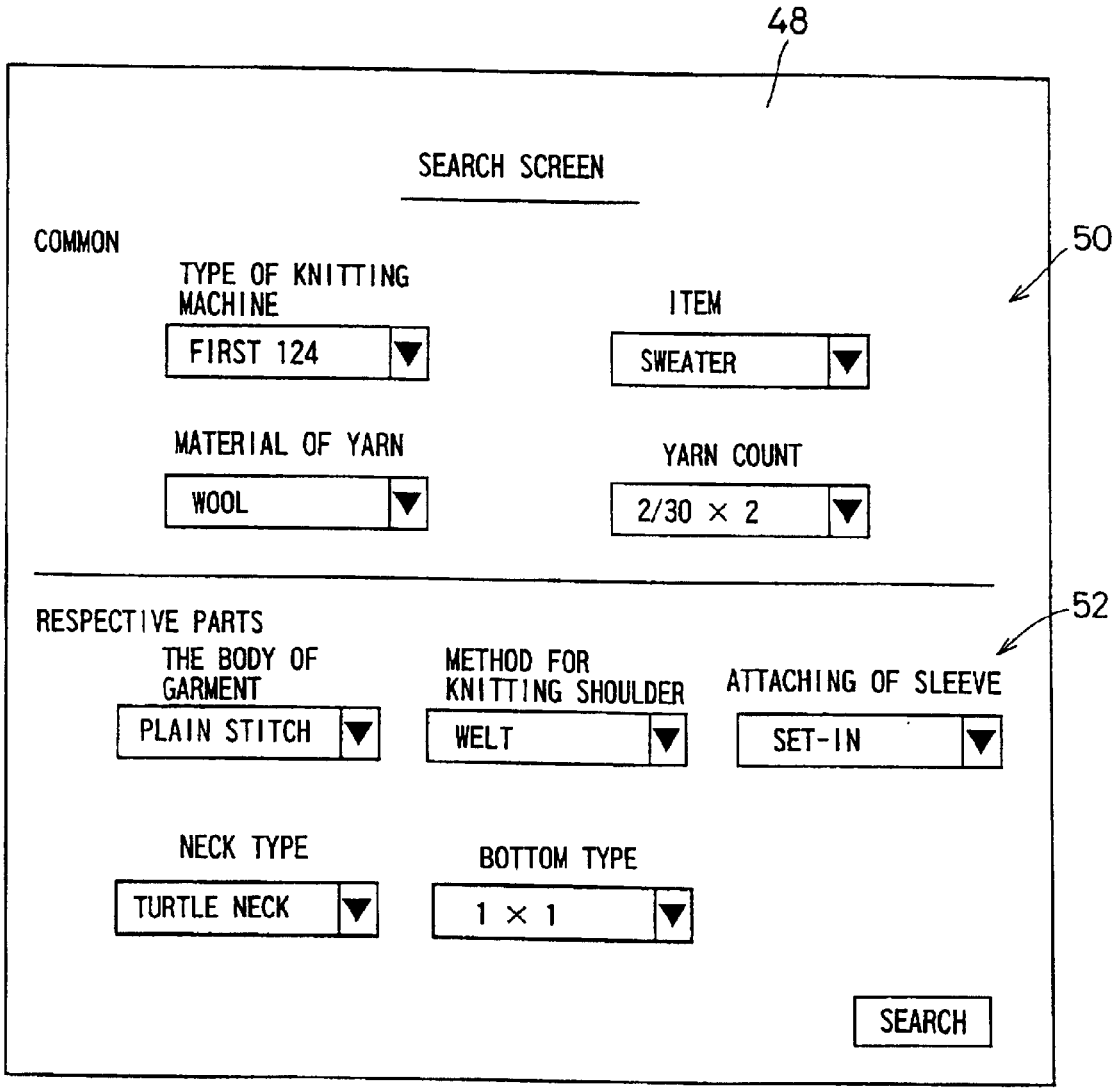
FIG. 6 shows a searching condition input screen of a second embodiment.

An operator firstly inputs data of various kinds of parameters of the desired knitted product in accordance with a searching condition input screen 48 shown in FIG. 6. In the searching condition input screen 48, parameters 50 common to the parts respectively forming the basis of the desired knitted product and parameters 52 for each of the parts such as the body of a garment, neck type, attaching for sleeves, etc. are inputted.

The searching means 24 searches the fabrics adapted to searching conditions for each part of the desired knitted product from among search information stored in search information storing means 22 on the basis of the inputted data. Then, searched results 54 as shown in FIG. 7 are displayed on the monitor 14.

The most similar fabrics to that of the desired knitted product are selected for each part from the searched results by the searching means 24. When only one fabric is similar to that of the desired knitted product for each of the parts, this fabric is selected. When a plurality of fabrics are similar to that of the desired knitted fabric for each of the parts, the most similar fabric is selected from among them, or a plurality of desired fabrics are selected. Then, knitting machine adjusting data for the selected plural fabrics is analyzed by analyzing means 26.

The knitting machine adjusting data for the fabrics similar to that of the desired knitted product for each of the parts is read out for each part by the output means 30. Then, the knitting machine adjusting data for each of the parts is collectively used as data for trial knitting of the desired knitted product.

In this embodiment, the knitting machine adjusting data stored in knitting machine adjusting data storing means 28 of a hard disk 10 may not be the data of completed fabrics as products such as a sweater or a vest. The knitting machine adjusting data may be the data of fabrics only of respective parts forming a knitted product such as a neck or a sleeve.

As described above, fabrics with knitting results similar to that of the desired knitted product for each of the parts are searched to knit the desired knitted product by a knitting machine using the knitting machine adjusting data for the searched fabrics. Therefore, even when fabrics with knitting results which are entirely similar to that of the desired knitted product are not stored in the knitting machine adjusting data storing means 28, if fabrics similar to that of the knitted product for each of the parts exist, the fabrics are searched. Then, the knitting machine adjusting data for the similar parts is read out.

Thus, even when the quantity of storage of data for the fabrics with knitting results which are stored in the knitting machine adjusting data storing means 28 is small, data similar to knitting machine adjusting data suitable for the desired knitted product can be obtained.

Figure 8:
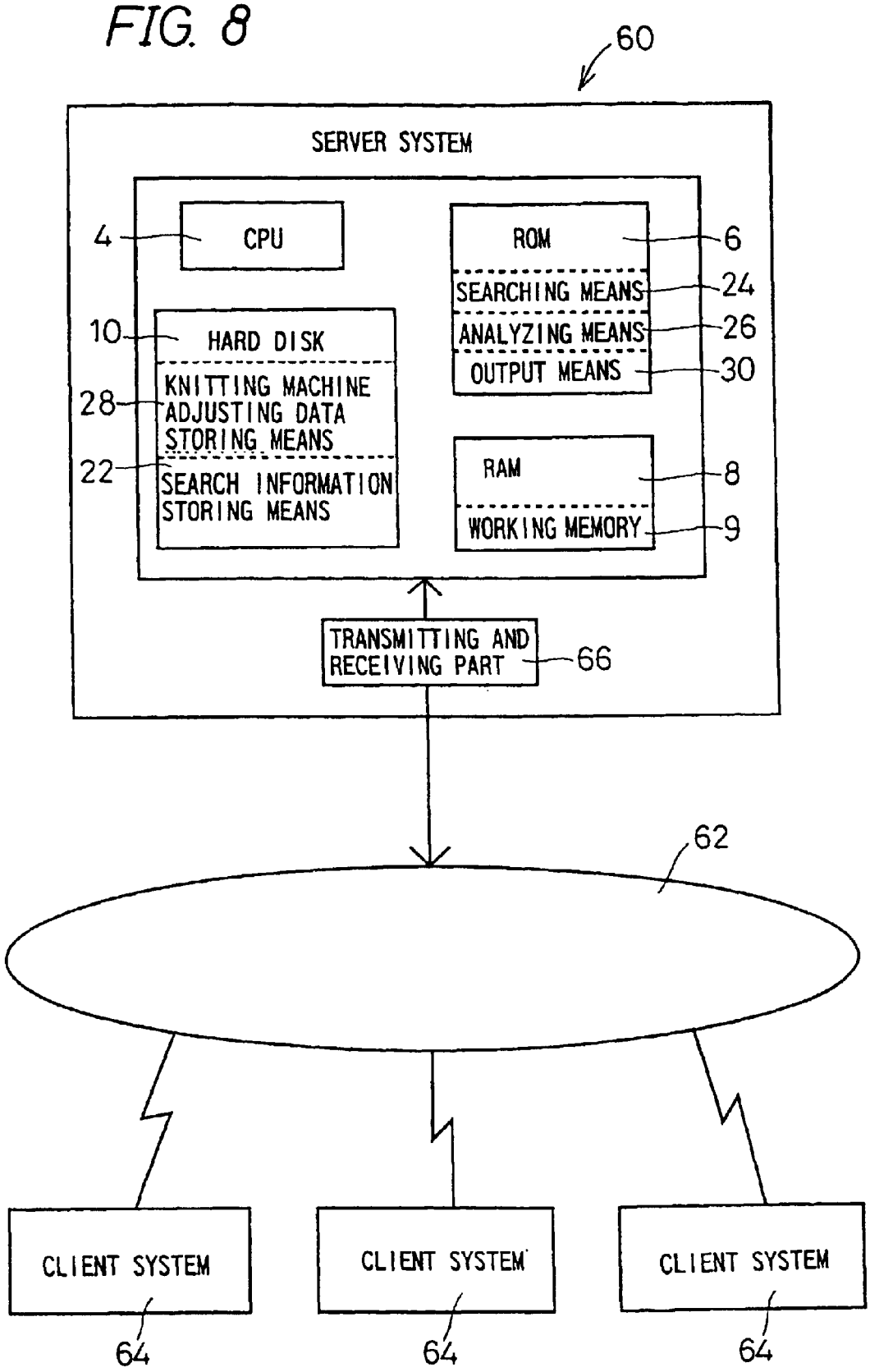
FIG. 8 shows a schematic structure of a knitting support server system of a third embodiment.

FIG. 8 shows, as other embodiment of the invention, a structure of a knitting support server system 60 for knitted products installed as a Web server to which the knitting support system is connected through a communication network such as an Internet.

The structure of the knitting support server system 60 is similar to that of the first embodiment. Parts corresponding to those of the first embodiment are denoted by the same reference numerals. The knitting support server system 60 of this embodiment is connected to client systems 64 by a general Internet system 62 to transmit data to and receive data from each of the client systems 64 through the Internet system 62 by a transmitting and receiving part 66 provided in the server system 60. Further, the knitting support server system 60 is not provided with knitting program preparing means for preparing a knitting program.

The knitting support server 60 includes the CPU 4 for carrying out various kinds of data processing, the ROM 6 for storing various kinds of programs, the RAM 8 having the working memory 9 and the hard disk 10.

The ROM 6 stores a program which forms the searching means 24 for searching search information stored in the search information storing means 22 of the hard disk 10, the analyzing means 26 for analyzing the searched results by the searching means 24 and the output means 30 for reading and outputting the knitting machine adjust data for fabrics corresponding to the searched results by the searching means 24 from the knitting machine adjusting data storing means 28 in the hard disk 10.

An operator inputs the data of various kinds of parameters 33 of a desired knitted product by connecting to the server system 60 via the Internet system 62 from the client systems 64. The searching means 24 searches fabrics adapted to searching conditions from among the search information stored for each of the fabrics on the basis of the inputted data. The searched results are transmitted to the client systems 64 by the output means 30 and the transmitting and receiving part 66. Then, the operator requests the server system 60 to select the received fabrics and transmit the knitting machine adjusting data corresponding to the selected fabrics. As a result of searching by the searching means 24, when a plurality of fabrics are searched, desired fabrics are selected from among the plural fabrics as required to carry out an analyzing process such as balancing these knitting machine adjusting data by the analyzing means 26. Then, the analyzed knitting machine adjusting data is transmitted to the client systems 64.

Each client system 64 may register the knitting machine adjusting data for fabrics with knitting results and the search information for searching it in the server system 60.

The above-described server system 60 is disposed in, for instance, a headquarters. The client systems 64 connected to the server system 60 through the Internet system 62 are respectively installed in apparel factories or factory boutiques or the like. Thus, knitting machine adjusting data for the plural fabrics with knitting results and the search information for searching it can be shared. Accordingly, each of the client systems 64 can use the latest data at any time to obtain the knitting machine adjusting data for fabrics similar to that of a knitted product to be knitted.

In the above-described embodiments, the knitting machine adjusting data and the search information for searching it are respectively stored in the knitting machine adjusting data storing means 28 and the search information storing means 22 in the hard disk 10. The knitting machine adjusting data and the search information are coordinated with each other by the fabric codes 34 to achieve an efficiency of a searching process. However, the knitting machine adjusting data may not be separated from the search information and they may be stored in the same storing means to treat them as one data base to which a record is set for each fabric.

Further, the knitting machine adjusting data for the fabrics with knitting results is stored in the knitting machine adjusting data storing means 28. However, the knitting machine adjusting data prepared on the basis of the knitting machine adjusting data for the fabrics with the knitting results may be stored. Further, the knitting machine adjusting data calculated as a theoretical value on the basis of respective parameters or the like may be stored.

Although the preferred embodiments of the invention are described above, the invention is not limited to the above-described embodiments and other forms may be made within a range without departing the gist of the invention.

INDUSTRIAL APPLICABILITY

According to the invention, even in a knitted product to be firstly formed, similar fabrics can be searched from among fabrics with knitting results and adjust data for a knitting machine used upon knitting the fabrics can be obtained. According to such a support, data similar to knitting machine adjusting data suitable for a desired knitted product can be obtained with ease.

Further, as a result of searching by the searching means, a plurality of fabrics similar to that of a knitted product to be knitted may exist. In this case, the knitting machine adjusting data for the desired plural fabrics are analyzed and balanced so that the knitting machine adjusting data can be obtained in which variation between the plural fabrics is suppressed.

Further, the searching means searches respectively fabrics similar to those of respective parts of the desired knitted product. The output means outputs knitting machine adjusting data for the fabrics similar to those of the respective parts of the desired knitted product searched by the searching means. Accordingly, even when the quantity of storage of data for the fabrics with knitting results stored in the knitting machine adjusting data storing means is small, the data similar to knitting machine adjusting data suitable for the desired knitted product can be obtained.

Further, according to the invention, the knitting support server system is connected to communicate with a plurality of client systems so as to transmit and receive data. The searching means searches fabrics similar to that of a knitted product to be knitted among from the search information of a plurality of fabrics with knitting results on the basis of the searching conditions respectively inputted from the client systems. Then, the knitting machine adjusting data corresponding to the fabrics searched in accordance with requests from the client systems is transmitted to the client systems. According, the client systems can respectively share the knitting machine adjusting data for the plural fabrics with the knitting results and the search information for searching it and can obtain the latest data at any time.

What is claim is:

1. A knitting support system comprising:

knitting machine adjusting data storing means for storing knitting machine adjusting data for many fabrics;

search information storing means for storing various kinds of parameters of the fabrics as search information for searching fabrics similar to that of a knitted product to be knitted from among the knitting machine adjusting data stored in the knitting machine adjusting data storing means;

searching means for inputting parameters of the knitted product to be knitted as searching conditions and searching fabrics similar to that of the knitted product to be knitted from among the search information stored in the search information storing means in accordance with the inputted searching conditions; and output means for reading and outputting the knitting machine adjusting data for the fabrics corresponding to the searched result of the searching means, from the knitting machine adjusting data storing means.

2. The knitting support system of claim 1, further comprising analyzing means for analyzing and balancing the knitting machine adjusting data for plural desired fabrics from among a plurality of sets of knitting machine adjusting data, when, as a result of searching by the searching means, the plurality of sets of knitting machine adjusting data for fabrics similar to that of the knitted product to be knitted are obtained.

3. The knitting support system of claim 1, wherein the searching means searches fabrics similar to those of respective parts of the knitted product to be knitted from among the search information stored in the search information storing means, in accordance with parameters for the respective parts of the knitted product to be knitted which parameters are inputted as searching conditions, respectively, and the output means reads and outputs the knitting machine adjusting data for fabrics similar to those of the respective parts corresponding to the searched results of the searching means from the knitting machine adjusting data storing means.

4. A server system having transmitting and receiving means connected to communicate so as to transmit data to and receive data from a plurality of client systems, the server system comprising:

knitting machine adjusting data storing means for storing knitting machine adjusting data for many fabrics;

search information storing means for storing various kinds of parameters of fabrics as search information for searching fabrics similar to that of the knitted product to be knitted from among the knitting machine adjusting data stored in the knitting machine adjusting data storing means;

searching means for searching fabrics similar to that of the knitted product to be knitted from among the search information stored in the search information storing means in accordance with parameters of the knitted product to be knitted transmitted from the client systems which are received as the searching conditions by the server system; and output means for reading and outputting the knitting machine adjusting data for the fabrics corresponding to the searched results of the searching means, from the knitting machine adjusting data storing means, the knitting machine adjusting data outputted from the output means being transmitted to the client systems by the transmitting and receiving means.

* * * * *

UNITED STATES PATENT AND TRADEMARK OFFICE

CERTIFICATE OF CORRECTION

PATENT NO. : 6,845,285 B2
DATED : January 18, 2005
INVENTOR(S) : Sadatoshi Kakimoto et al.

It is certified that error appears in the above-identified patent and that said Letters Patent is hereby corrected as shown below:

Title page,
Item [54], Title, please change "KNITTING SUPPORT SYSTEM AND KNITTED PRODUCT AND KNITTING SUPPORT SERVER SYSTEM" to -- KNITTING SUPPORT SYSTEM AND KNITTING SUPPORT SERVER SYSTEM FOR KNITTED PRODUCTS --.
Item [73], Assignee, please change "Shima Seiko Manufacturing Limited" to -- Shima Seiki Manufacturing Limited --.

Signed and Sealed this

Tenth Day of May, 2005

JON W. DUDAS
*Director of the United States Patent and Trademark Office*